US006286267B1

(12) United States Patent
Lindgren

(10) Patent No.: US 6,286,267 B1
(45) Date of Patent: Sep. 11, 2001

(54) WINDOW HAVING AN IMPROVED SASH STRUCTURE

(75) Inventor: Claes Lindgren, Farum (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/297,048

(22) PCT Filed: Nov. 13, 1997

(86) PCT No.: PCT/DK97/00517

§ 371 Date: Apr. 28, 1999

§ 102(e) Date: Apr. 28, 1999

(87) PCT Pub. No.: WO98/22682

PCT Pub. Date: May 28, 1998

(30) Foreign Application Priority Data

Nov. 19, 1996 (DK) ..... 1318/96

(51) Int. Cl.[7] ..... E04B 7/18
(52) U.S. Cl. ..... 52/72; 52/200
(58) Field of Search ..... 52/72, 200

(56) References Cited

U.S. PATENT DOCUMENTS

| | | | | |
|---|---|---|---|---|
| 4,594,821 | * | 6/1986 | Bechtold | 52/72 |
| 4,986,039 | * | 1/1991 | Weisner | 52/72 |
| 5,103,603 | * | 4/1992 | Verby | 52/72 |
| 5,148,643 | * | 9/1992 | Sampson | 52/200 |
| 5,199,234 | * | 4/1993 | Guhl | 52/200 |
| 5,207,036 | * | 5/1993 | Sampson | 52/72 |
| 5,669,186 | * | 9/1997 | Verby | 52/72 |

FOREIGN PATENT DOCUMENTS

| | | | | |
|---|---|---|---|---|
| 512 003 | | 10/1971 | (CH) . | |
| 3705777 | * | 9/1988 | (DE) | 52/200 |
| 74 858 | | 10/1952 | (DK) . | |
| 251804 | * | 1/1988 | (EP) | 52/200 |
| 2 347 519 | | 11/1977 | (FR) . | |
| 119 380 | | 11/1970 | (NO) . | |
| WO 95/05519 | | 2/1995 | (WO) . | |

* cited by examiner

*Primary Examiner*—Beth A. Stephan
(74) *Attorney, Agent, or Firm*—Venable; John P. Shannon; Chad C. Anderson

(57) ABSTRACT

The sash profiles of the top-hung sash structure have substantially L-shaped cross sections with small wall thickness, and the insulating pane (4) is manufactured with dimensions corresponding to the exterior dimensions of the frame structure and is secured to the sash profiles (5–7) by adhesive sealing (21, 22). A resilient gasket profile (11–13) is secured to the outwards facing edge surfaces (17–19) of the top, bottom and side members of the frame structure as abutment for the interior side of the insulating pane.

5 Claims, 5 Drawing Sheets

WINDOW HAVING AN IMPROVED SASH STRUCTURE

BACKGROUND OF THE INVENTION

The present invention relates to a window, in particular for mounting in an inclined roof surface, comprising a frame structure with top, bottom and side members and a relative to the frame structure openable, top-hung sash structure with an insulating pane encased between top, bottom and side members of metal or plastic profiles, the sash profiles being metal sheet profiles with substantially L-shaped cross-section and small wall thickness, and a resilient gasket profile being secured to the outwards facing edge surfaces of the top, bottom and side members of the frame structure as abutment for the interior side of the insulating pane.

Windows of this type are for example, known from DK patent No. 74858 and U.S. Pat. No. 4,776,141. In such windows it is a general problem to obtain sufficient tightness relative to the room inside, in particular if for reasons of appearance, when the windows are for instance to be used in protected buildings, traditional building materials cannot be used.

Windows of this simple design are thus, first and foremost, suited for more or less uninhabited areas, for instance, ceilings or outhouses. In living-quarters, condensation will, however, easily form on the interior side of the insulating pane, when the cold outside air gets in contact with the hot and humid indoor air. Condensation is a well-known problem within this field and this problem has been solved in many satisfactory, but expensive and complicated

SUMMARY OF THE INVENTION

The object of the invention is to improve a window of the type, which is both easy and inexpensive to manufacture, but which at the same time, meets the demands made on a window, and which is to be used in occupied areas.

This object is met according to the invention by a window which is characterized in that the insulating pane is manufactured with such dimensions that its edges, when the window is closed, are placed substantially in flush with the exterior sides of the frame structure, that the sash profiles comprise a comparatively narrow wall portion in abutment on an edge portion of the exterior side of the insulating pane and a second wall portion connected therewith through a rectangular corner and abutting an edge surface of the insulating pane, said second wall portion overlapping, in the closed position of the window, the exterior side of the frame member lying behind, and in that the insulating pane is secured in said wall portions of the sash profiles solely by adhesive sealing.

In addition to the desired simple manufacture it is obtained that by manufacturing the insulating pane with such dimensions in combination with the positioning of the gasket profile on the outwards facing edge surfaces of the frame structure, smaller demands are made on the design of the sash, and the formation of cold bridges is avoided, whereby the tendency of condensation in the window is reduced. Furthermore, the design of the sash profiles provides a good weather-proof protection of the interior parts of the window.

The sash profiles are preferably mutually connected by welding, and the adhesive sealing of the insulating pane is preferably made by a silicone adhesive, which results in a simple and inexpensive manufacture.

The design of the sash construction makes it possible to make the top hinge of the window integral with the sash profile.

BRIEF DESCRIPTION OF THE DRAWINGS

The invention will be explained in the following with reference to an embodiment as shown in the accompanying drawings in which.

DETAILED DESCRIPTION OF PREFERRED EMBODIMENTS

Figure 1:
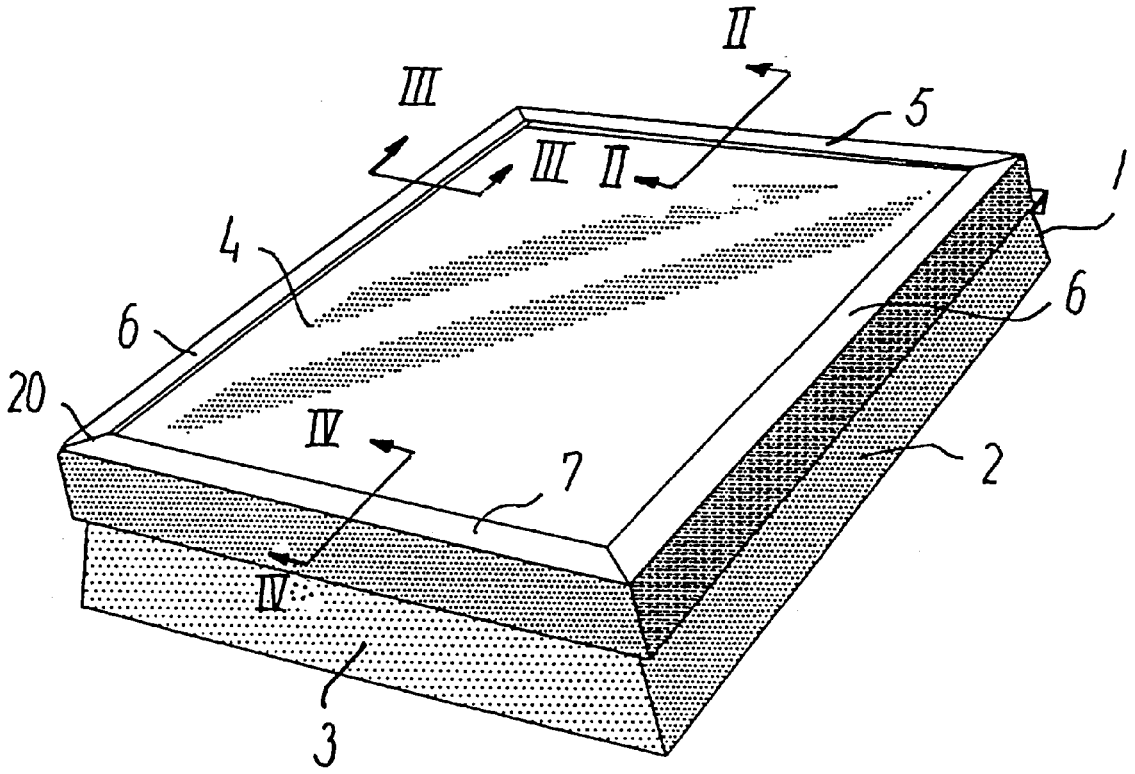
FIG. 1 is a perspective view of a top-hung window to be mounted in an inclined roof surface.

In the embodiment shown in the drawings, a top-hung roof or skylight window according to the invention comprises a frame structure having a top member 1, side members 2 and a bottom member 3 and a top-hung sash structure openable relative thereto, in which an insulating pane 4 is enchased between a top member 5, side members 6 and a bottom member 7.

Figure 2:
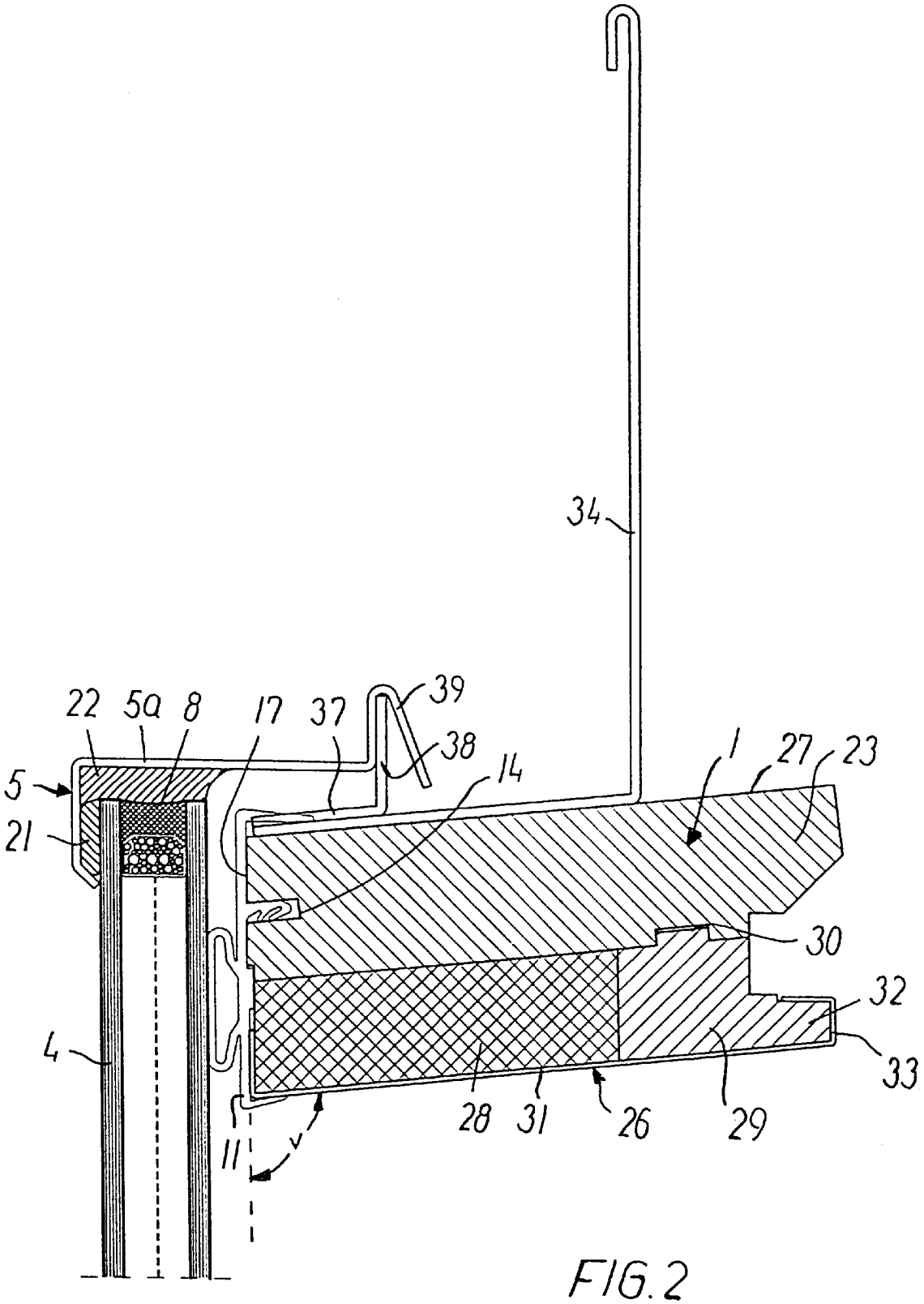
FIGS. 2, 3 and 4 show a cross-section of the top, side and bottom members of the frame and sash structures along the lines II—II, III—III and IV—IV in FIG. 1.
Figure 3:
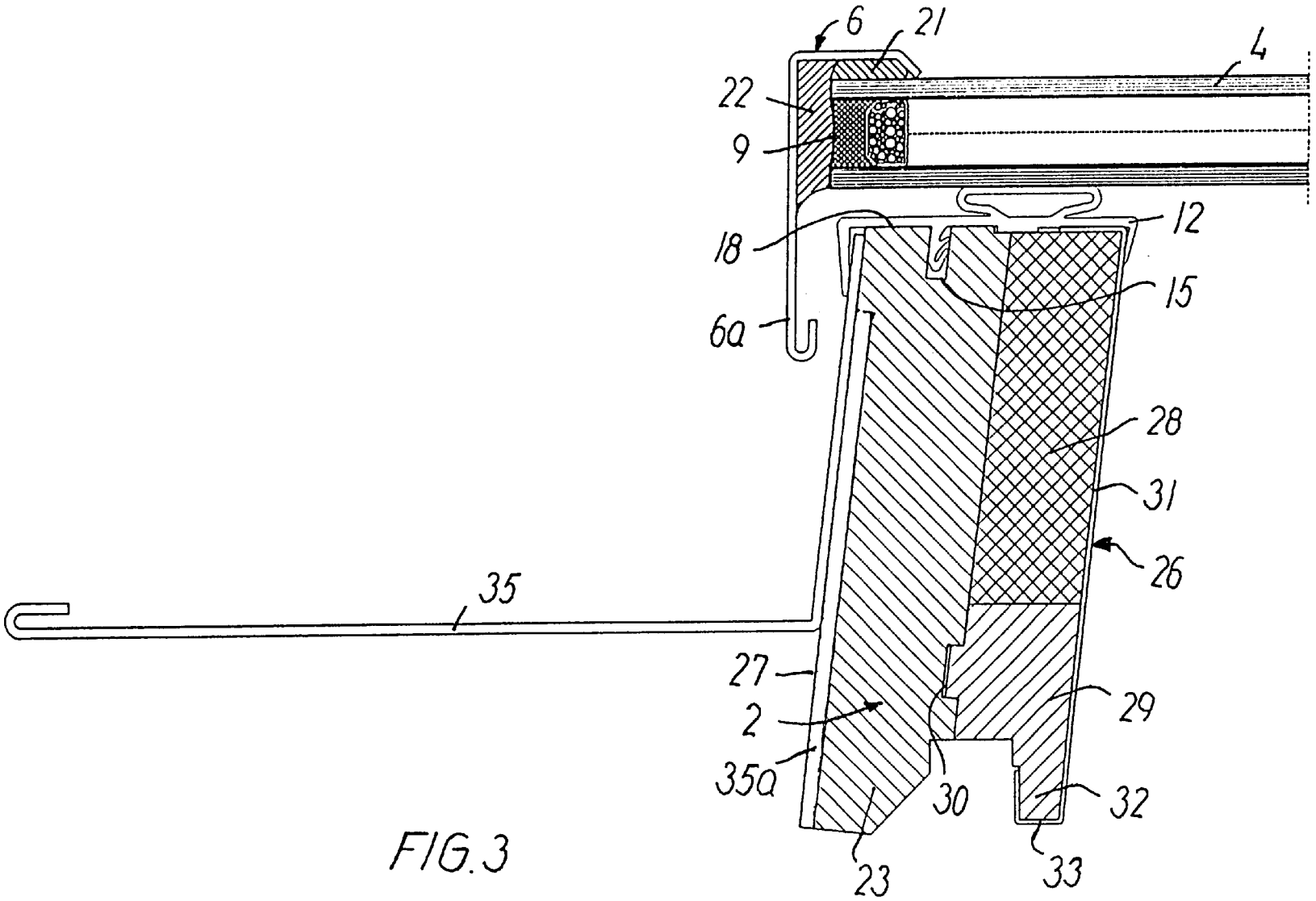
Figure 4:
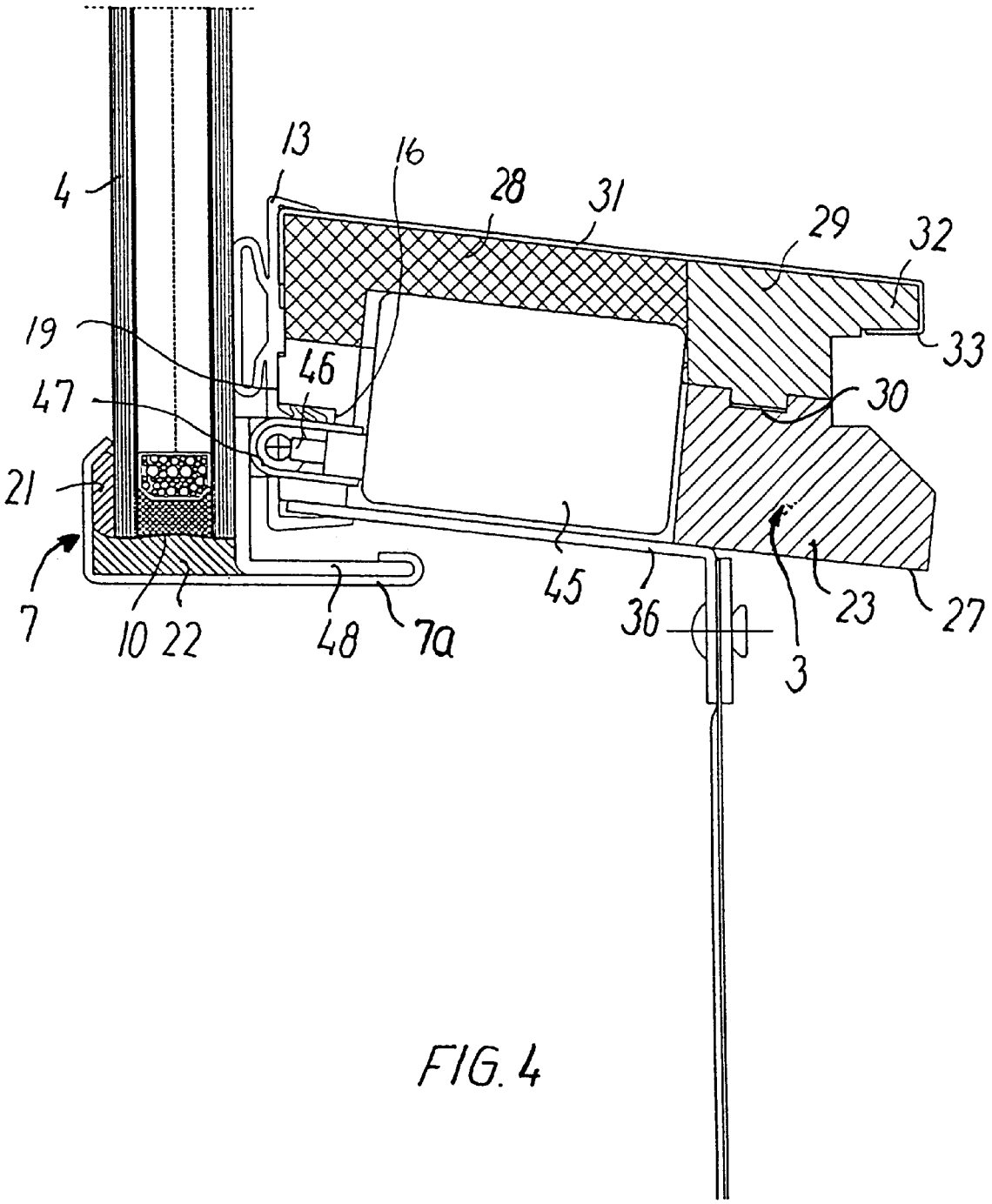

As will appear from the cross-sectional views in FIGS. 2–4, the insulating pane 4 is manufactured with dimensions which substantially correspond to the exterior measures of the frame structure, such that the edge surfaces 8–10 of the pane 4 are substantially flush with the exterior sides of the top, side and bottom members 1–3 of the frame structure, and such that the insulating pane 4 in the closed position of the window directly abuts resilient sealing profiles 11–13, which are retained in grooves 14–16 in exterior edge surfaces 17–19 of the top, side and bottom members 1–3 of the frame structure.

The sash profiles 5–7 are in the embodiment shown designed as metal sheet profiles with substantially L-shaped cross-section with a small wall thickness and mutually connected by corner joints 20, which, as shown in FIG. 1, may be made as 45° angular joints.

In this very simple and light sash structure, the insulating pane 4 is secured by an adhesive sealing, for instance, as shown, by joints 21 and 22 of silicone adhesive.

The wall 5*a*–7*a* of the L-shaped cross-section of the sash profiles 5–7, which abuts the edge surfaces 8–10 of the insulating pane 4, is, as shown, manufactured with such a width that in the closed position it overlaps the exterior side of the frame member 1–3 lying behind it and is at its interior edge folded for providing a softly rounded edge.

Figure 6:
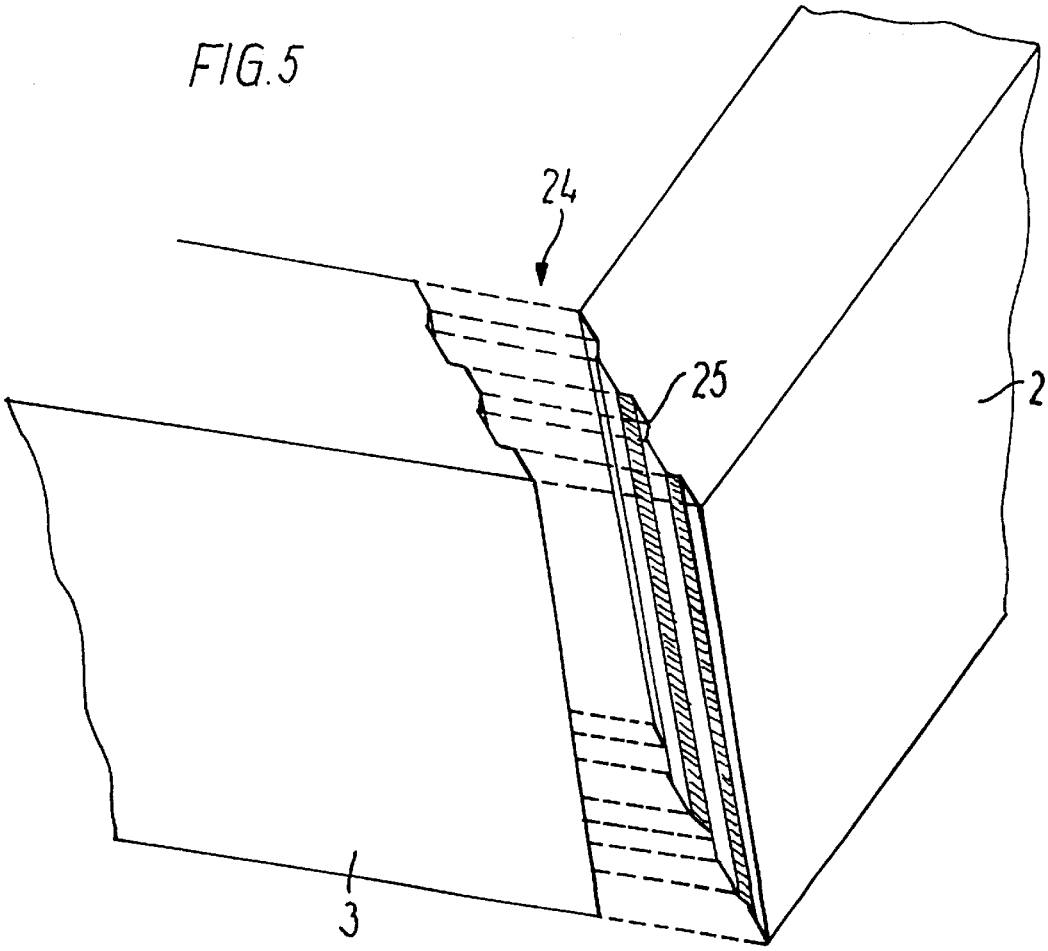

With a view to obtaining a good thermal insulation, the top, side and bottom members 1–3 of the frame are made from wood profiles 23, which, as shown in FIG. 6, are connected at the corners in profiled mitre joints 24, for instance with undulating abutment surfaces 25. This method of joining has the advantage that it partly provides a safe mutual locking of the top, side and bottom members 1–3, partly gives optimum insulation properties, the end surfaces of the wood profiles being removed from the exterior sides of the frame members.

In the embodiment shown, the frame wood profiles 23 are manufactured with a substantially parallelogram-shaped cross-section, in which the above-mentioned exterior edge surfaces 17–19 lie in a common plane, with which the adjacent opposite side surfaces 26, 27 of the profile cross-section form an angle v of, for instance, 95 to 140°, in the embodiment shown 96°. By this profile cross-section, which provides the structure with the shape of a low frustum of a pyramid, an advantageous possibility is obtained of manufacturing the frame structure with oblique interior sides, which is desirable with a view to mounting various forms of accessories like, for instance, roller blinds and insect nets, and with a minimum consumption of material, the profiles 23 being, as shown, manufactured with a comparatively small thickness.

In the embodiment shown, the thermal insulation property of the frame structures is improved by the fact that to the side of the profiles 23, which is intended for forming the interior side of the frame structure, additionally, substantially rod-shaped insulating elements 28 are retained, which may be manufactured from a suitable, well insulating material.

As will be seen from FIGS. 2–4, the insulating elements 28 extend across a part of the width of the wood profiles 23 and are supported by abutment lists 29 connected with the wood profiles 23 by groove and tongue joints 30.

On the interior sides 26, the top, side and bottom members 1–3 of the frame structures end in a covering of metal sheet profiles 31, which covers the entire interior side and extends towards the edge area of the insulating pane 4. By this metal sheet covering such an improved heat transmission towards the insulating pane is obtained that in practice it has turned out to be possible to completely prevent condensation, something which otherwise frequently happens at the border areas of roof or skylight windows. The heat transmission typically has the effect that at a room temperature of 20° C. and an outdoor temperature of 0° C., a temperature of about 14° C. is obtained on the interior side of the insulating pane 4.

The fact that the abutment lists 29, as shown, are designed such that they at a distance from the wood profiles 23 form a nose portion 32, may be exploited for retaining the covering profile 31 by manufacturing it with a folded edge portion 33.

This design of the frame structure entails that the wood profiles 23 and the abutment lists 29 connected therewith may be releasably connected with the insulating elements 28 and the covering profiles 31, which can easily be exchanged for lacquering/change of colour or for mounting of fittings for accessories, and which entails a simple, and from an environmental point of view advantageous construction, which makes it possible at a subsequent dismounting to easily separate the frame structure into wood profiles, insulating elements and metal profiles with a view to reusing the materials to a high degree.

On the exterior sides the top, side and bottom members 1–3 of the frame structure are in a manner known per se covered by flashing profiles 34–36 of metal sheets.

For fastening of the window to the underlying roof structure, grooves 35*a* have, as shown in FIG. 3, been provided in the frame side members 2 for receiving fixing angles or straps, which are subsequently secured to the roof structure.

The sash and frame constructions shown make it in an advantageous manner, possible to make the top hinge of the window integral with the top members 1 and 5 of the frame and sash structures, respectively.

For this purpose a fitting member 37 with a hinge pin forming member in the form of a projecting wall portion 38 may be connected with the flashing profile 34 for the frame top member 1, whereas a substantially V-shaped hook member 39 is made integral with the wall portion 5*a* of the L-shaped metal sheet profile for the sash top member 5, said hook member 39 being hinged on the upward wall portion 38 and having an opening angle in the range of 20 to 30°.

Figure 5:
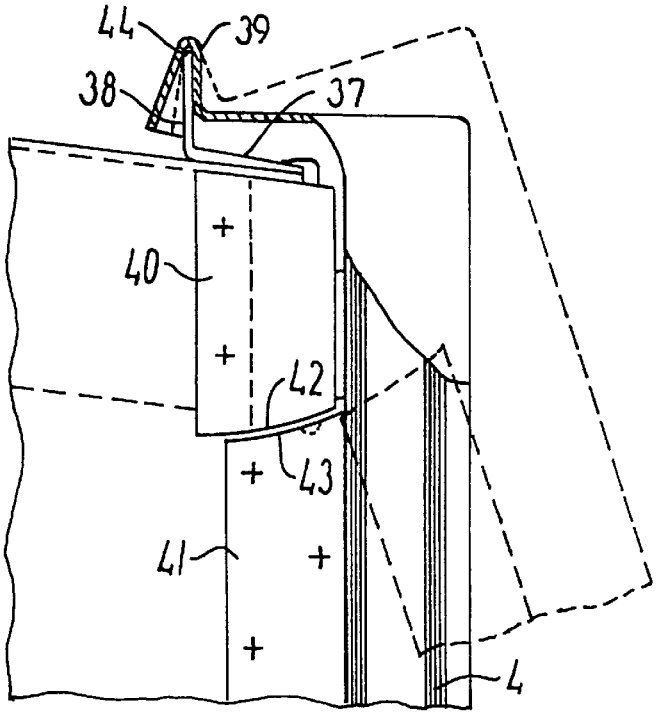
FIG. 5 shows the design of a top hinge for the window, a lateral and partially sectional view of the sash, and FIG. 6 the design of corner joints between the top, side and bottom members of the frame structure.

To hold the hook member 39 and the projecting wall portion 38 in mutual engagement and to make a turning of the sash structure to a ventilation position possible, securing means have, as shown in FIG. 5, been secured to adjacent pairs of side members 2 and 6 of the frame and sash structures, said securing means comprising, in the embodiment shown, holding means 40 and 41, for instance in the form of blocks of a wear-resistant plastic material, with part-cylindrical guide surfaces 42 and 43 with axis in the pivot axis of the hinge 44. Within an opening angle range, which is smaller than the opening angle of the V-shaped hook member 39, the holding means 40 and 41 will keep the hinge members 38 and 39 in mutual engagement, whereas they, when the sash structure is turned beyond this opening angle range to the position shown by a dotted line in FIG. 5, will be disengaged and thus allow an easy dismounting of the sash structure relative to the frame structure.

For opening the sash structure relative to the frame structure to a ventilation position within the opening angle range, a window operator may in a manner known, be mounted in connection with the bottom members 3 and 7 of the frame and sash structures, for instance, an electrically driven chain operator with an operator housing 45 accommodated in a recess in the wood profile 23 and the insulating element 28 and an operating chain 46, which may be detachably connected with a sash fitting 47 secured to a for instance, L-shaped console 48 in connection with the L-shaped sash profile 7*a*, for instance secured to its folded edge portion.

What is claimed is:

1. A window for mounting in an inclined roof surface, comprising:

a frame structure defining laterally exterior sides and having top, bottom and side members (1–3) having outward facing edge surfaces;

a top-hung sash structure, the sash structure being openable relative to the frame structure and having an insulating pane (4) encased between top, bottom and side members (5–7) comprising sash profiles, the sash profiles being metal sheet profiles with substantially L-shaped cross-sections, and said insulating pane having an exterior side; and a resilient gasket profile (11–13) secured to outward facing edge surfaces (17–19) of the top, bottom and side members of the frame structure as abutment for an interior side of the insulating pane, wherein the insulating pane (4) has an edge that, when the window is closed, is substantially flush with the laterally exterior sides of the frame structure, wherein the sash profiles (5–7) each comprise a comparatively narrow wall portion in abutment on an edge portion of the exterior side of the insulating pane and a second wall portion (5*a*–7*a*) connected with the comparatively narrow wall portion through a rectangular corner and facing an edge surface of the insulating pane, said second wall portion overlapping, in the closed position of the window, one of the exterior sides of the frame member (1–3), and wherein the insulating pane (4) is secured to said wall portions of the sash profiles (5–7) solely by an adhesive sealing (21, 22).

2. A window according to claim 1, characterized in that the sash profiles (5–7) are mutually connected by welding.

3. A window according to claim 1, characterized in that the second wall portion (5*a*) of the top member (5) of the sash structure is integral with a substantially V-shaped hook member (39) which, together with a substantially L-shaped fitting member (37) connected to the top member (1) of the frame structure, the fitting member having a projecting wall portion (38) engaging the V-shaped hook member, forms a pivoting hinge for the sash structure relative to the frame structure.

4. A window according to claim 3, characterized in that holding means (40,41) are fastened to at least one adjacent pair of the side members (2,6) of the frame and sash structures, which holding means, within a predetermined opening angle range for the sash structure and calculated from the closed position, hold the V-shaped hook member (39) and said projecting wall portion (38) in mutual engagement, but which, when turning the sash structure beyond said opening angle range, allow removal of the sash structure from the frame structure.

5. A window according to claim 1, characterized in that the adhesive sealing (21,22) of the insulating pane (4) is a silicone adhesive.

* * * * *